US007621977B2

(12) United States Patent
Anderson et al.

(10) Patent No.: US 7,621,977 B2
(45) **Date of Patent: *Nov. 24, 2009**

(54) SYSTEM AND METHOD OF PRODUCING METALS AND ALLOYS

(75) Inventors: Richard P. Anderson, Clarendon Hills, IL (US); Donn Armstrong, Lisle, IL (US); Jacobsen Lance, Minooka, IL (US)

(73) Assignee: Cristal US, Inc., Woodridge, IL (US)

( * ) Notice: Subject to any disclaimer, the term of this patent is extended or adjusted under 35 U.S.C. 154(b) by 260 days.

This patent is subject to a terminal disclaimer.

(21) Appl. No.: 10/530,775

(22) PCT Filed: Sep. 3, 2003

(86) PCT No.: PCT/US03/27651

§ 371 (c)(1),
(2), (4) Date: Jan. 18, 2006

(87) PCT Pub. No.: WO2004/033736

PCT Pub. Date: Apr. 22, 2004

(65) Prior Publication Data

US 2006/0230878 A1 Oct. 19, 2006

Related U.S. Application Data

(60) Provisional application No. 60/416,630, filed on Oct. 7, 2002, provisional application No. 60/328,022, filed on Oct. 9, 2001.

(51) Int. Cl.
*B22F 9/28* (2006.01)
*C22B 34/10* (2006.01)

(52) U.S. Cl. ..... 75/351; 75/367; 75/617; 75/620

(58) Field of Classification Search ..... None
See application file for complete search history.

(56) References Cited

U.S. PATENT DOCUMENTS 1,771,928 A 7/1930 Jung (Continued)

FOREIGN PATENT DOCUMENTS

AU 587782 11/1985

(Continued)

OTHER PUBLICATIONS

Kelto et al. "Titanium Powder Metallurgy —A Perspective"; Conference: Powder Metallurgy of Titanium Alloys, Las Vegas, Nevada, Feb. 1980, pp. 1-19.

(Continued)

*Primary Examiner*—George Wyszomierski
(74) *Attorney, Agent, or Firm*—Dunlap Codding, P.C.

(57) ABSTRACT

A system and method of producing an elemental material or an alloy from a halide of the elemental material or halide mixtures. The vapor halide of an elemental material or halide mixtures are introduced into a liquid phase of a reducing metal of an alkali metal or alkaline earth metal or mixtures thereof present in excess of the amount needed to reduce the halide vapor to the elemental material or alloy resulting in an exothermic reaction between the vapor halide and the liquid reducing metal. Particulates of the elemental material or alloy and particulates of the halide salt of the reducing metal are produced along with sufficient heat to vaporize substantially all the excess reducing metal. Thereafter, the vapor of the reducing metal is separated from the particulates of the elemental material or alloy and the particulates of the halide salt of the reducing metal before the particulate reaction products are separated from each other.

10 Claims, 4 Drawing Sheets

U.S. PATENT DOCUMENTS 2,205,854 A 6/1940 Kroll
2,607,675 A 8/1952 Gross
2,647,826 A 8/1953 Jordan
2,816,828 A 12/1957 Benedict et al.
2,823,991 A 2/1958 Kamlet
2,827,371 A 3/1958 Quin
2,835,567 A 5/1958 Willcox
2,846,303 A 8/1958 Keller et al.
2,846,304 A 8/1958 Keller et al.
2,882,143 A 4/1959 Schmidt
2,882,144 A 4/1959 Follows et al.
2,890,112 A 6/1959 Winter
2,895,823 A 7/1959 Lynskey
2,915,382 A 12/1959 Hellier et al.
2,941,867 A 6/1960 Maurer
2,944,888 A 7/1960 Quin
3,058,820 A 10/1962 Whitehurst
3,067,025 A 12/1962 Chisholm
3,085,871 A 4/1963 Griffiths
3,085,872 A 4/1963 Kenneth
3,113,017 A 12/1963 Homme
3,331,666 A 7/1967 Robinson et al.
3,519,258 A 7/1970 lshizuka
3,535,109 A 10/1970 Ingersoll
3,650,681 A 3/1972 Sugahara et al.
3,825,415 A 7/1974 Johnston et al.
3,836,302 A 9/1974 Kaukeinen
3,847,596 A 11/1974 Holland
3,867,515 A 2/1975 Bohl et al.
3,919,087 A 11/1975 Brumagim
3,927,993 A 12/1975 Griffin
3,943,751 A 3/1976 Akiyama et al.
3,966,460 A 6/1976 Spink
4,007,055 A 2/1977 Whittingham
4,009,007 A 2/1977 Fry
4,017,302 A 4/1977 Bates et al.
4,070,252 A 1/1978 Bonsack
4,128,421 A 12/1978 Marsh et al.
4,141,719 A 2/1979 Hakko
4,149,876 A 4/1979 Rerat
4,190,442 A 2/1980 Patel
4,331,477 A 5/1982 Kubo et al.
4,379,718 A 4/1983 Grantham et al.
4,401,467 A * 8/1983 Jordan ..... 420/417
4,402,741 A 9/1983 Pollet et al.
4,414,188 A 11/1983 Becker
4,423,004 A 12/1983 Ross
4,425,217 A 1/1984 Beer
4,432,813 A 2/1984 Williams
4,445,931 A 5/1984 Worthington
4,454,169 A 6/1984 Hinden et al.
4,518,426 A 5/1985 Murphy
4,519,837 A 5/1985 Down
4,521,281 A 6/1985 Kadija
4,555,268 A 11/1985 Getz
4,556,420 A 12/1985 Evans et al.
4,604,368 A 8/1986 Reeve
4,606,902 A 8/1986 Ritter
RE32,260 E 10/1986 Fry
4,687,632 A 8/1987 Hurd
4,689,129 A 8/1987 Knudsen
4,725,312 A 2/1988 Seon et al.
4,828,008 A 5/1989 White et al.
4,830,665 A 5/1989 Winand
4,839,120 A 6/1989 Baba et al.
4,877,445 A 10/1989 Okudaira et al.
4,897,116 A 1/1990 Scheel
4,902,341 A 2/1990 Okudaira et al.
4,915,729 A 4/1990 Boswell et al.
4,923,577 A 5/1990 McLaughlin et al.
4,940,490 A 7/1990 Fife et al.
4,941,646 A 7/1990 Stelts et al.
4,985,069 A 1/1991 Traut
5,028,491 A 7/1991 Huang et al.
5,032,176 A * 7/1991 Kametani et al. ..... 75/416
5,055,280 A 10/1991 Nakatani et al.
5,064,463 A 11/1991 Ciomek
5,082,491 A 1/1992 Rerat
5,147,451 A * 9/1992 Leland ..... 75/620
5,149,497 A 9/1992 McKee et al.
5,160,428 A 11/1992 Kuri
5,164,346 A 11/1992 Giunchi et al.
5,167,271 A 12/1992 Lange et al.
5,176,741 A 1/1993 Bartlett et al.
5,176,810 A 1/1993 Volotinen et al.
5,211,741 A 5/1993 Fife
5,259,862 A 11/1993 White et al.
5,338,379 A 8/1994 Kelly
5,356,120 A 10/1994 König et al.
5,427,602 A 6/1995 DeYoung et al.
5,437,854 A 8/1995 Walker et al.
5,439,750 A 8/1995 Ravenhall et al.
5,448,447 A 9/1995 Chang
5,460,642 A 10/1995 Leland
5,498,446 A 3/1996 Axelbaum et al.
5,580,516 A 12/1996 Kumar
H1642 H 4/1997 Jenkins
5,637,816 A 6/1997 Schneibel
5,779,761 A 7/1998 Armstrong et al.
5,897,830 A 4/1999 Abkowitz et al.
5,914,440 A 6/1999 Celik et al.
5,948,495 A 9/1999 Stanish et al.
5,951,822 A 9/1999 Knapick et al.
5,954,856 A 9/1999 Pathare et al.
5,958,106 A 9/1999 Armstrong et al.
5,986,877 A 11/1999 Pathare et al.
5,993,512 A 11/1999 Pargeter et al.
6,010,661 A 1/2000 Abe et al.
6,027,585 A 2/2000 Patterson et al.
6,040,975 A 3/2000 Mimura
6,099,664 A 8/2000 Davies
6,103,651 A 8/2000 Leitzel
6,136,062 A 10/2000 Loffeholz et al.
6,180,258 B1 1/2001 Klier
6,193,779 B1 2/2001 Reichert et al.
6,210,461 B1 4/2001 Elliott
6,238,456 B1 5/2001 Wolf et al.
6,309,570 B1 10/2001 Fellabaum
6,309,595 B1 10/2001 Rosenberg et al.
6,409,797 B2 6/2002 Armstrong et al.
6,432,161 B1 8/2002 Oda et al.
6,488,073 B1 12/2002 Blenkinsop et al.
6,502,623 B1 1/2003 Schmitt
6,602,482 B2 8/2003 Kohler et al.
6,689,187 B2 2/2004 Oda
6,727,005 B2 4/2004 Gimondo et al.
6,745,930 B2 6/2004 Schmitt
6,824,585 B2 11/2004 Joseph et al.
6,861,038 B2 3/2005 Armstrong et al.
6,884,522 B2 4/2005 Adams et al.
6,902,601 B2 6/2005 Nie et al.
6,921,510 B2 7/2005 Ott et al.
6,955,703 B2 10/2005 Zhou et al.
7,041,150 B2 * 5/2006 Armstrong et al. ..... 75/351
7,351,272 B2 * 4/2008 Armstrong et al. ..... 75/351
7,410,610 B2 8/2008 Woodfield et al.
7,435,282 B2 10/2008 Armstrong et al.
7,445,658 B2 11/2008 Armstrong et al.
7,501,007 B2 3/2009 Anderson et al.
7,501,089 B2 3/2009 Armstrong et al.
2002/0050185 A1 5/2002 Oda
2002/0152844 A1 10/2002 Armstrong et al.
2003/0061907 A1 4/2003 Armstrong et al.
2003/0145682 A1 8/2003 Anderson et al.

| | | | |
|---|---|---|---|
| 2004/0123700 | A1 | 7/2004 | Zhou et al. |
| 2005/0081682 | A1 | 4/2005 | Armstrong et al. |
| 2005/0150576 | A1 | 7/2005 | Venigalla |
| 2005/0225014 | A1 | 10/2005 | Armstrong et al. |
| 2005/0284824 | A1 | 12/2005 | Anderson et al. |
| 2006/0086435 | A1 | 4/2006 | Anderson et al. |
| 2006/0102255 | A1 | 5/2006 | Woodfield et al. |
| 2006/0107790 | A1 | 5/2006 | Anderson et al. |
| 2006/0123950 | A1 | 6/2006 | Anderson et al. |
| 2006/0150769 | A1 | 7/2006 | Armstrong et al. |
| 2006/0230878 | A1 | 10/2006 | Anderson et al. |
| 2007/0017319 | A1 | 1/2007 | Jacobsen et al. |
| 2007/0079908 | A1 | 4/2007 | Jacobsen et al. |
| 2007/0180951 | A1 | 8/2007 | Armstrong et al. |
| 2007/0180952 | A1 | 8/2007 | Lanin et al. |
| 2008/0031766 | A1 | 2/2008 | Kogut et al. |
| 2008/0152533 | A1 | 6/2008 | Ernst et al. |
| 2008/0187455 | A1 | 8/2008 | Armstrong et al. |
| 2008/0199348 | A1 | 8/2008 | Armstrong et al. |

FOREIGN PATENT DOCUMENTS

| | | |
|---|---|---|
| AU | 2003263081 | 6/2004 |
| CA | 2196534 | 2/1996 |
| EP | 0298698 | 1/1989 |
| EP | 0299791 | 1/1989 |
| EP | 1441039 | 7/2004 |
| EP | 1657317 | 5/2006 |
| GB | 722184 | 1/1955 |
| GB | 778021 | 7/1957 |
| JP | 31007808 | 9/1956 |
| JP | 49042518 | 4/1974 |
| JP | 51010803 | 4/1976 |
| JP | 60255300 | 12/1985 |
| JP | 6112837 | 1/1986 |
| JP | 62065921 | 3/1987 |
| JP | 64047823 | 2/1989 |
| JP | 4116161 | 4/1992 |
| JP | 05078762 | 3/1993 |
| JP | 10502418 | 3/1998 |
| JP | 11090692 | 4/1999 |
| JP | 2001279345 | 10/2001 |
| NO | 90840 | 1/1958 |
| RU | 411962 | 1/1974 |
| WO | WO96/04407 | 2/1996 |
| WO | WO98/24575 | 6/1998 |
| WO | WO2004/022269 | 3/2004 |
| WO | WO2004/022797 | 3/2004 |
| WO | WO2004/022798 | 3/2004 |
| WO | WO2004/022799 | 3/2004 |
| WO | WO2004/022800 | 3/2004 |
| WO | WO2004/026511 | 4/2004 |
| WO | WO2004/028655 | 4/2004 |
| WO | WO2004/033736 | 4/2004 |
| WO | WO2004/033737 | 4/2004 |
| WO | WO2004/048622 | 10/2004 |
| WO | WO2005/019485 | 3/2005 |
| WO | WO2005/021807 | 3/2005 |
| WO | WO2005/023725 | 3/2005 |
| WO | WO2005/042792 | 5/2005 |
| WO | WO2007/044635 | 4/2007 |
| WO | WO2007/089400 | 8/2007 |
| WO | WO2008/013518 | 1/2008 |
| WO | WO2008/079115 | 7/2008 |

OTHER PUBLICATIONS

Mahajan et al. "Microstructure Property Correlation in Cold Pressed and Sintered Elemental Ti-6A1-4V Powder Compacts"; Conference: Powder Metallurgy of Titanium Alloys, Las Vegas, Nevada, Feb. 1980, pp. 189-202.

DeKock et al. "Attempted Preparation of Ti-6-4 Alloy Powders from $TiCl_4$, AI, $VCl_4$, and Na"; Metallurgical Transactions B, vol. 18B, No. 1, Process Metallurgy, Sep. 1987, pp. 511-517.

Upadhyaya "Metal Powder Compaction", Powder Metallurgy Technology, Published by Cambridge International Science Publishing, 1997; pp. 42-67.

Moxson et al. "Production and Applications of Low Cost Titanium Powder Products"; The international Journal of Powder Metallurgy, vol. 34, No. 5, 1998, pp. 45-47.

Alt "Solid-Liquid Separation, Introduction"; Ulmann's Encyclopedia of Industrial Chemistry, © 2002 by Wiley-VCH Verlag GmbH & Co., Online Posting Date: Jun. 15, 2000, pp. 1-7.

Gerdemann et al. "Characterization of a Titanium Powder Produced Through a Novel Continuous Process"; Published by Metal Powder Industries Federation, 2000, pp. 12.41-12.52.

Moxson et al. "Innovations in Titanium Powder Processing"; Titanium Overview, JOM, May 2000, p. 24.

Gerdemann "Titanium Process Technologies"; Advanced Materials & Processes, Jul. 2001, pp. 41-43.

Lü et al. "Laser-Induced Materials and Processes for Rapid Prototyping" Published by Springer, 2001, pp. 153-154.

Lee et al. "Synthesis of Nano-Structured Titanium Carbide by Mg-Thermal Reduction"; Scripta Materialia, 2003, pp. 1513-1518.

Chandran et al. "$TiB_w$-Reinforced Ti Composites: Processing, Properties, Application Prospects, and Research Needs"; Ti-B Alloys and Composites Overview, JOM, May 2004, pp. 42-48.

Chandran et al. "Titanium-Boron Alloys and Composites: Processing, Properties, and Applications"; Ti-B Alloys and Composites Commentary, JOM, May 2004 pp. 32 and 41.

Hanusiak et al. "The Prospects for Hybrid Fiber-Reinforced Ti-TiB-Matrix Composites"; Ti-B Alloys and Composites Overview, JOM, May 2004, pp. 49-50.

Kumari et al. "High-Temperature Deformation Behavior of Ti-$TiB_w$ In-Situ Metal-Matrix Composites"; Ti-B Alloys and Composites Research Summary, JOM, May 2004, pp. 51-55.

Saito "The Automotive Application of Discontinuously Reinforced TiB-Ti Composites"; Ti-B Alloys and Composites Overview, JOM, May 2004, pp. 33-36.

Yolton "The Pre-Alloyed Powder Metallurgy of Titanium with Boron and Carbon Additions"; Ti-B Alloys and Composites Research Summary, JOM, May 2004, pp. 56-59.

Research Report; P/M Technology News, Crucible Research, Aug. 2005, vol. 1, Issue 2, 2 pages.

* cited by examiner

SYSTEM AND METHOD OF PRODUCING METALS AND ALLOYS

RELATED APPLICATIONS

This application, pursuant to 37 C.F.R. 1.78(c), claims priority based on U.S. Provisional Application Ser. No. 60/416,630 Oct. 7, 2002 and U.S. Provisional Application Ser. No. 60/328,022 filed Oct. 9, 2001.

BACKGROUND OF THE INVENTION

This invention relates to the production and separation of elemental material from the halides thereof and has particular applicability to those metals and non metals for which a reduction of the halide to the element is exothermic. Particular interest exists for titanium, and the present invention will be described with particular reference to titanium, but is applicable to other metals and non metals such as aluminum, arsenic, antimony, beryllium, boron, tantalum, gallium, vanadium, niobium, molybdenum, iridium, rhenium, silicon osmium, uranium, and zirconium, all of which produce significant heat upon reduction from the halide to the metal. For the purposes of this application, elemental materials include those metals and non metals listed above or in Table 1 and the alloys thereof.

This invention is an improvement in the separation methods disclosed in U.S. Pat. No. 5,779,761, U.S. Pat. No. 5,958,106 and U.S. Pat. No. 6,409,797, the disclosures of which are incorporated herein by reference. The above-mentioned '761, '106 and '797 patents disclose a revolutionary method for making titanium which is satisfactory for its intended purposes and in fact continuously produces high grade titanium and titanium alloys. However, the method described in the '761 patent, the '106 and the '797 patent produces a product which includes excess liquid reducing metal. The present invention resides the discovery that by maintaining the excess reducing metal in vapor phase by controlling the temperature of reaction and the amount of excess reducing metal, the separation of the produced material is made easier and less expensive.

More particularly, it has been found that by controlling the amount of excess metal, the temperature of the reaction products of the exothermic reaction can be maintained between the boiling point of the reducing metal and the boiling point of the salt produced which causes excess reducing metal to remain in the vapor phase after the reaction facilitating the later aqueous separation of the salt produced from the elemental material or alloy. This results in a substantial economic savings and simplifies the separation and recovery process.

SUMMARY OF THE INVENTION

Accordingly, it is an object of the present invention is to provide a method and system for producing metals or non metals or alloys thereof by an exothermic reaction between vapor phase halides and a liquid reducing metal in which the reducing metal is maintained in the vapor phase after the exothermic reaction in order to facilitate separation of the reaction products and the products made thereby.

Yet another object of the present invention is to provide an improved method and system for producing elemental materials or an alloy thereof by an exothermic reaction of a vapor halide of the elemental material or materials or halide mixtures thereof in a liquid reducing metal in which a sweep gas is used to separate the reducing metal in the vapor phase from the products of the exothermic reaction and the products made thereby.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
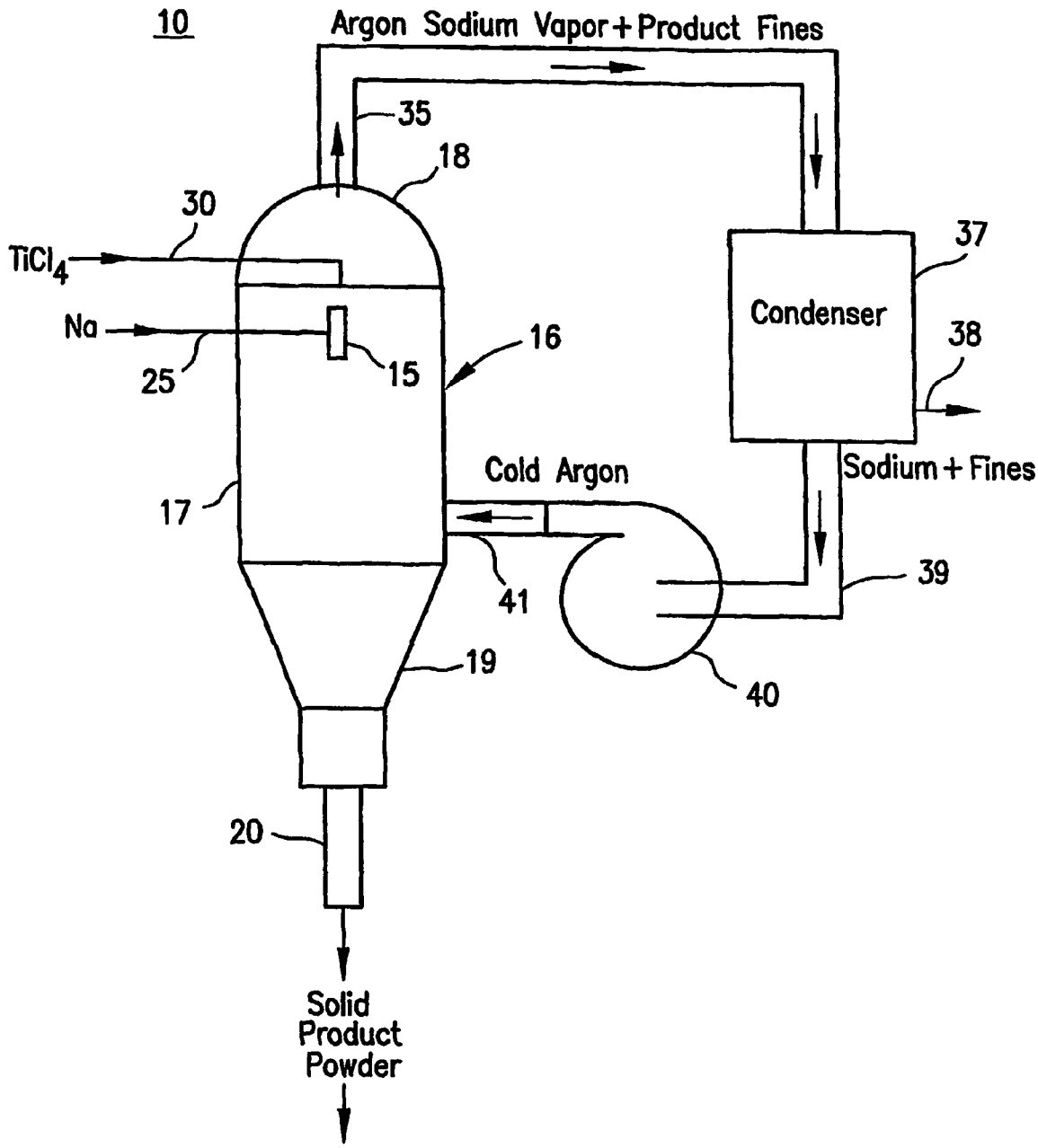
FIG. 1 is a schematic representation of a system for practicing one method of the present invention.

Referring now to FIG. 1 of the drawings, there is disclosed a system 10 for the practice of the invention. The system 10 includes a reactor 15 generally vertically displaced in this example in a drop tower vessel 16, the drop tower 16 having a central generally cylindrical portion 17, a dome top 18 and a frustoconical shaped bottom portion 19. A product outlet 20 is in communication with the frustoconical portion 19. The reactor 15 essentially consists of an apparatus illustrated in FIG. 2 of U.S. Pat. No. 5,958,106 in which a tube through which liquid metal flows as a stream has inserted thereinto a halide(s) vapor so that the vapor halide(s) is introduced into the liquid reducing metal below the surface and is entirely surrounded by the liquid metal during the ensuing exothermic reaction.

A reducing metal inlet pipe 25 enters the reactor 15 near the top 18 and a vapor halide inlet 30 also enters the drop tower 16 near then top 18. However, it will be understood by a person of ordinary skill in the art that a variety of configurations of inlet conduits may be used without departing from the spirit and scope of the present invention.

As illustrated, there is an overhead exit line 35 through which vapor leaving reactor 15 can be drawn. The overhead exit line 35 leads to a condenser 37 where certain vapors are condensed and discharged through an outlet 38 and other vapor or gas, such as an inert gas, is pumped by a pump 40 through a heat exchanger 45 (see FIG. 2) and line 41 into the drop tower 16, as will be explained.

For purposes of illustration, in FIG. 1 there is shown a reducing metal of sodium. It should be understood that sodium is only an example of reducing metals which may be used in the present invention. The present invention may be practiced with an alkali metal or mixtures of alkali metals or an alkaline earth metal or mixtures of alkaline earth metals or mixtures of alkali and alkaline earth metals. The preferred alkali metal is sodium because of its availability and cost. The preferred alkaline earth metal is magnesium for the same reason.

The preferred halide(s) to be used in the process of the present invention is a chloride, again because of availability and cost. The metals and non-metals which may be produced using the subject invention are set forth in Table 1 hereafter; the alloys of the metals and non-metals of Table 1 are made by introducing mixed halide vapor into the reducing metal.

TABLE 1

| FEEDSTOCK | HEAT kJ/g |
|---|---|
| $TiCl_4$ | −5 |
| $AlCl_3$ | −5 |
| $SbCl_3$ | −4 |
| $BeCl_2$ | −6 |
| $BCl_3$ | −8 |
| $TaCl_6$ | −4 |
| $VCl_4$ | −6 |
| $NbCl_5$ | −5 |
| $MoF_5$ | −10 |
| $GaCl_3$ | −5 |
| $UF_6$ | −4 |
| $ReF_6$ | −8 |
| $ZrCl_4$ | −4 |
| $SiCl_4$ | −11 |

All of the elements in Table 1 result in an exothermic reaction with an alkali metal or alkaline earth metal to provide the halide(s) of the reducing metal and the metal or alloy of the halide introduced into the reducing metal. Ti is discussed only by way of example and is not meant to limit the invention. Because of the large heat of reaction, there has been the problem that the reaction products fuse into a mass of material which is difficult to process, separate and purify. Discussions of the Kroll and Hunter processes appear in the patents referenced above.

The patents disclosing the Armstrong process show a method of producing a variety of metals and alloys and non-metals in which the heat of reaction resulting from the exothermic reaction is controlled by the use of excess liquid reducing metal and the reaction proceeds instantaneously by introducing the metal halide into a continuous phase of liquid reducing metal, otherwise described as a liquid continuum. The use of a subsurface reaction described in the Armstrong process has been an important differentiation between the batch processes and other suggested processes for making metals such as titanium and the process disclosed in the Armstrong et al. patents and application.

Nevertheless, the use of excess liquid reducing metal requires that the excess liquid metal be separated before the products can be separated. This is because the excess liquid reducing metal usually explosively reacts with water or is insoluble in water whereas the particulate products of the produced metal and the produced salt can be separated with water wash.

By way of example, when titanium tetrachloride in vapor form is injected into sodium liquid, an instantaneous reaction occurs in which titanium particles and sodium chloride particles are produced along with the heat of reaction. Excess sodium absorbs sufficient heat that the titanium particles do not sinter to form a solid mass of material. Rather, after the excess sodium is removed, such as by vacuum distillation suggested in the aforementioned Armstrong patents, the remaining particulate mixture of titanium and sodium chloride can be easily separated with water.

Nevertheless, vacuum distillation is expensive and it is preferred to find system and method that will permit the separation of the particulate reaction products of the reaction directly with water without the need of preliminary steps. This has been accomplished in the present invention by the discovery that by judiciously limiting the amount of excess reducing metal present, the boiling point of the produced salt will be the limiting temperature of the reaction and so long as the temperature of reaction products is maintained above the boiling point of the reducing metal and below the boiling point of the produced salt, any excess reducing metal present will remain in the vapor phase which can be efficiently and inexpensively removed so that the particulates accumulating at the bottom 19 of the reaction vessel or drop tower 16 are entirely free of liquid reducing metal, thereby permitting the separation of the particulate reaction products with water, obviating the need for a separate vacuum distillation step.

Figure 2:
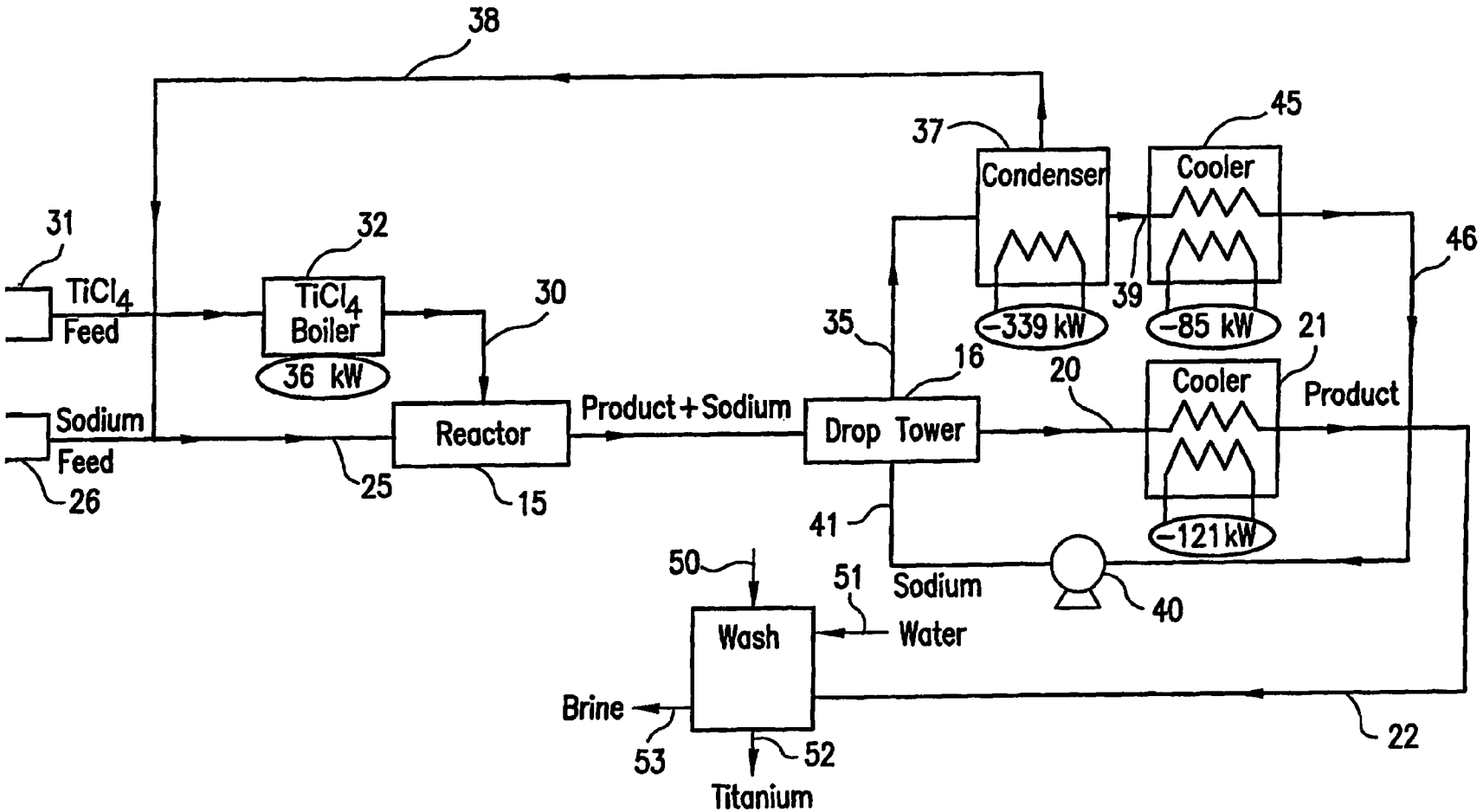
FIG. 2 is a flow sheet of a representative example of the process as practiced in the system of FIG. 1 showing various flow rates and temperatures in the system.

As illustrated in FIG. 2, the halide gases of the elemental material or alloy to be made such as titanium tetrachloride, come from a storage or supply 31. The titanium tetrachloride is fed, in one specific example only, at the rate indicated on FIG. 2, to a boiler 32 and from there via the inlet pipe 30 to the reactor 15. The sodium reducing metal is fed, in one specific example only at the rate indicated on FIG. 2, from a storage container 26 through an inlet line 25 to the reactor 15. As before stated, the liquid sodium flows in the specific example as indicated on FIG. 2 in a 50% excess quantity of the stoichiometric amount needed to convert the titanium tetrachloride to titanium metal and as indicated in FIG. 2 at a temperature of 200° C. at which the sodium is liquid.

In the reactor 15, as previously taught in the Armstrong patents and application, the continuous liquid phase of sodium is established into which the titanium tetrachloride vapor is introduced and instantaneously causes an exothermic reaction to occur producing large quantities of heat, and particulates of titanium metal and sodium chloride. The boiling point of sodium chloride is 1465° C. and becomes the upper limit of the temperature of the reaction products. The boiling point of sodium is 892° C. and is the lower limit of the temperature of the reaction products to ensure that all excess sodium remains in the vapor phase until separation from the particulate reaction products. A choke flow nozzle also known as a critical flow nozzle is well known and used in the line transmitting halide vapor into the liquid reducing metal, all as previously disclosed in the '761 and '106 patents. It is critical for the present invention that the temperature of the reaction products as well as the excess reducing metal be maintained between the boiling point of the reducing metal, in this case sodium, and the boiling point of the salt produced, in this case sodium chloride.

The vapors exiting the reactor 15 are drawn through exit line 35 along with an inert sweep gas introduced through the inert gas inlet 41. The inert gas, in this example argon, may be introduced at a temperature of about 200° C., substantially lower than the temperature of the reaction products which exit the tower 16 at 800° C. The argon sweep gas flows, in the example illustrated in FIG. 1, countercurrently to the direction of flow of the particulate reaction products. The sodium vapor is swept by the argon into the outlet 35 along with whatever product fines are entrained in the gas stream comprised of argon and sodium vapor at about 900° C. and transmitted to the condenser 37. In the condenser 37, as shown in FIG. 2, heat exchange occurs in which the sodium vapor is cooled to a liquid at about 400° C. and recycled to the sodium feed or inlet 25 via line 38 and the argon is cooled from 400° C., the temperature at which it exits the condenser 37 by a cooler 45 to the 200° C. temperature at which it is recycled as shown in FIG. 2. It is seen therefore, that the inert gas preferably flows in a closed loop and continuously recirculates as long as the process is operational. The product fines present in the condenser 37 will be removed by filters (not shown) in both the sodium recycling line 38 and in the line 39 exiting the condenser 37 with the inert gas.

As the inert gas moves upwardly through the vessel or drop tower 16, there is contact between the colder inert gas and the reaction particulates which are at a higher temperature. As seen from FIG. 2, the sodium vapor exits the drop tower 16 at a temperature of about 900° C. while the particulate product exits the reactor 15 at a temperature not greater than 1465° C. After being cooled by contact with the argon gas, the particulate product, in this example, is at a temperature of about 800° C. at the exit or product outlet 20. The product 20 which leaves the vessel 16 at about 800° C. enters a cooler 21, see FIG. 2, to exit therefrom at 50° C. Thereafter, the product is introduced through line 22 to a water wash 50 in which water is introduced into a container through a line 51 and brine exits from the water wash 50 via line 53. The titanium particulates exit from the water wash through a line 52 for drying and further processing.

It should be understood that although titanium is shown to be the product in FIGS. 1 and 2 any of the elements or alloys thereof listed in Table 1 may be produced by the method of the present invention. The most commercially important metals at the present time are titanium and zirconium and their alloys. The most preferred titanium alloy for defense use is 6% aluminum, 4% vanadium, the balance substantially titanium. This alloy known as 6:4 titanium is used in aircraft industry, aerospace and defense. Zirconium and its alloys are important metals in nuclear reactor technology. Other uses are in chemical process equipment.

The preferred reducing metals at the present time because of cost and availability are sodium of the alkali metals and magnesium of the alkaline earth metals. The boiling point of magnesium chloride is 1418° C. and the boiling point of magnesium is 1107° C. Therefore, if magnesium were to be used rather than sodium as the reducing metal, then preferably the product temperature would be maintained between the boiling point of magnesium and the boiling point of magnesium chloride, if the chloride salt of the metal or alloy to be produced were to be used. The chlorides are preferred because of cost and availability.

One of the significant features of the present invention is the complete separation of reducing metal from the particulate reaction products as the reaction products leave the reactor 15 thereby providing at the bottom of the drop tower 16 a sodium free or reducing metal-free product which may then be separated with water in an inexpensive and uncomplicated process. If liquid sodium or other reducing metal is trapped within the product particulates, it must be removed prior to washing. Accordingly, the invention as described is a significant advance with respect to the separation of the metal or alloy particulates after production disclosed in the aforementioned Armstrong et al. patents and application.

Figure 3:
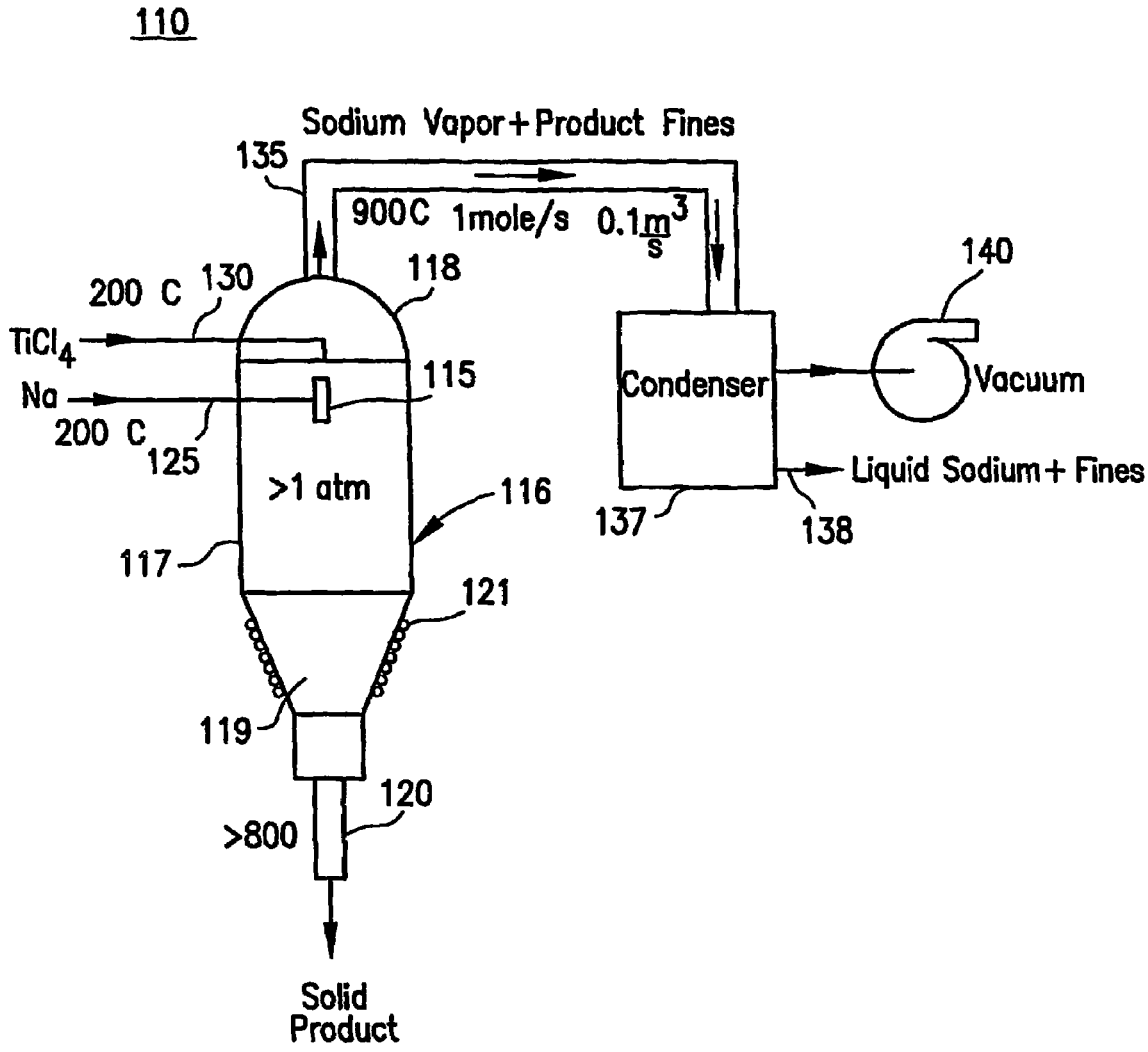
FIG. 3 is a schematic representation of another system for practicing another embodiment of the present invention.

Referring to FIG. 3, there is disclosed another embodiment of the present invention system 110 which includes a reactor 115 disposed within a drop tower 116 having a cylindrical center portion 117, a dome topped portion 118 and a frustoconical bottom portion 119 connected to a product outlet 120. A plurality of cooling coils 121 are positioned around the frustoconical portion 119 of the drop tower 116 for a purpose to be explained.

As in the system 10 shown in FIGS. 1 and 2, there is a metal halide inlet 130 and a reducing metal inlet 125 in communication with the reactor 115 disposed within the drop tower 116. An overhead exit line 135 leads from the dome top portion 118 of the drop tower 116 to a condenser 137 in fluid communication with a pump 140. A liquid reducing metal and product fine outlet 138 is also provided from the condenser 137.

In operation, the system 110 is similar to the system 10 in that a liquid reducing metal, for instance sodium or magnesium, is introduced via inlet 125 from a supply thereof at a temperature above the melting point of the metal, (the melting point of sodium is 97.8° C. and for Mg is 650° C.) such as 200° C. for sodium and 700° C. for Mg. The vapor halide of the metal or alloy to be produced, in this case titanium tetrachloride, is introduced from the boiler at a temperature of about 200° C. to be injected as previously discussed into a liquid so that the entire reaction occurs instantaneously and is subsurface. The products coming from the reactor 115 include particulate metal or alloy, excess reducing metal in vapor form and particulate salt of the reducing metal. In the system 110, there is no sweep gas but the drop tower 116 is operated at a pressure slightly in excess of 1 atmosphere and this by itself or optionally in combination with the vacuum pump 140 causes the reducing metal vapor leaving the reactor 115 to be removed from the drop tower 116 via the line 135. A certain amount of product fines may also be swept away with the reducing metal vapor during transportation from the drop tower 116 through the condenser 137 and the liquid reducing metal outlet 138. A filter (not shown) can be used to separate any fines from the liquid reducing metal which is thereafter recycled to the inlet 125.

Cooling coils 121 are provided, as illustrated on the bottom 119 of the drop tower 116. A variety of methods may be used to cool the drop tower 116 to reduce the temperature of the product leaving the drop tower 116 through the product outlet 120. As illustrated in FIG. 3, a plurality of cooling coils 121 may be used or alternatively, a variety of other means such as heat exchange fluids in contact with the container or heat exchange medium within the drop tower 116. What is important is that the product be cooled but not the reducing metal vapor so that the excess reducing metal in vapor phase can be entirely separated from the product prior to the time that the product exits the drop tower 116 through the product outlet 120.

In the example illustrated, titanium tetrachloride and liquid sodium enter the reactor 115 at a temperature of about 200° C. and titanium and salt exit the drop tower 116 through product outlet 120 at about 700° C. The excess sodium vapor leaves the dome 118 of the drop tower 116 at approximately 900° C. and thereafter is cooled in the condenser 137 to form liquid sodium (below 892° C.) which is then recycled to inlet 125. In this manner, dry product is produced, free of liquid reducing metal, without the need of a sweep gas.

Figure 4:
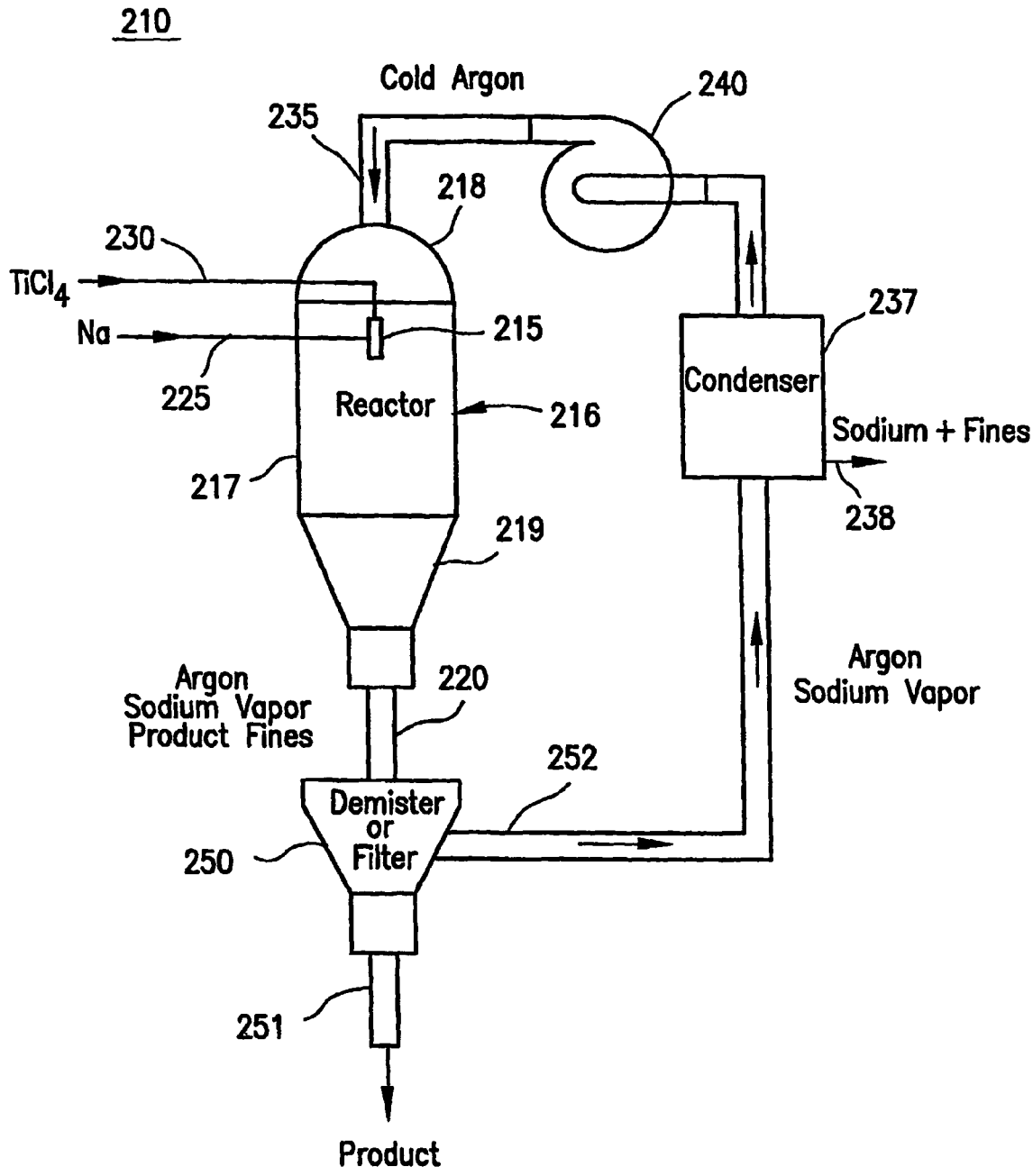
FIG. 4 is a schematic representation of another embodiment of the present invention.

Referring now to FIG. 4, there is disclosed another embodiment of the invention. A system 210 in which like parts are numbered in the 200 series as opposed to the 100 series. Operation of the system 210 is similar to the operation of the system 10 but in the system 210 an inert sweep gas flows co-currently with the product as opposed to the countercurrent flow as illustrated in system 10 and FIGS. 1 and 2. In the system 210 illustrated in FIG. 4, the gas flow is reversed in comparison to the system 10. In the system 210, the sweep gas such as argon, the reducing metal vapor such as sodium vapor and the product of titanium particles and sodium chloride exit through the outlet 220 into a demister or filter 250. The demister or filter 250 is in fluid communication with a condenser 237 and a pump 240 so that the sodium vapor and the argon along with whatever fines come through the demister or filter 250 are transported via a conduit 252 to the condenser 237. In the condenser 237, the sodium is cooled and condensed to a liquid, the fines are separated while the argon or inert gas is cooled and recycled via the pump 240 in line 235 to the drop tower 216. The other apparatus of the system 210 bear numbers in the 200 series that are identical to the numbers in the system 10 and 100 and represent the same part functioning in the same or similar manner.

It is seen that the present invention can be practiced with a sweep gas that is either countercurrent or co-current with the reaction products of the exothermic reaction between the halide and the reducing metal or without a sweep gas. An important aspect of the invention is the separation of the reducing metal in vapor phase prior to the separation of the produced metal and the produced salt. When using sodium as the reducing metal, the preferred excess sodium, that is the sodium over an above the stoichiometric amount necessary to reduce the metal halide, is in the range of from about 25% to about 125% by weight. More specifically, it is preferred that the excess sodium with respect to the stoichiometric amount required for reduction of the halide of the elemental material mixtures is from about 25% to about 85% by weight. When magnesium is used as the reducing metal as opposed to sodium, then the excess of magnesium in the liquid phase over and above the stoichiometric amount required for the reduction of the halide is in the range of from about 5% to about 150% by weight. More specifically, the preferred excess magnesium is in the range of from about 5% by weight to about 75% by weight with respect to the stoichiometric amount required for the reduction of the halide. More specifically, it is preferred, but not required, that the liquid reducing metal be flowing in a conduit as illustrated in FIG. 2 of the '106 patent previously referred to and incorporated herein by reference.

Various alloys have been made using the process of the present invention. For instance, titanium alloys including aluminum and vanadium have been made by introducing predetermined amounts of aluminum chloride and vanadium chloride and titanium chloride to a boiler or manifold and the mixed halides introduced into liquid reducing metal. For instance, grade 5 titanium alloy is 6% aluminum and 4% vanadium. Grade 6 titanium alloy is 5% aluminum and 2.5% tin. Grade 7 titanium is unalloyed titanium and paladium. Grade 9 titanium is titanium alloy containing 3% aluminum and 2.5% vanadium. Other titanium alloys include molybdenum and nickel and all these alloys may be made by the present invention.

In one specific example of the invention, adjustment was made to the sodium flow and temperature by controlling the power to the heater and pump to obtain an inlet temperature of 200° C. at a flow of 3.4 kg/min. This provided a production rate of 1.8 kg/min of titanium powder and required a feed of 6.9 kg/min of titanium tetrachloride gas for a stoichiometric reaction. The desired feed rate of titanium tetrachloride is obtained by controlling the pressure of the titanium tetrachloride vapor upstream of a critical flow nozzle by adjusting the power to the titanium tetrachloride boiler. At this stoichiometric ratio, the adiabatic reaction temperature (1465° C.) is the boiling temperature of the reaction product of sodium chloride, and a heat balance calculation shows that about 66% of the sodium chloride is vaporized.

$$0=\Delta H_{reaction}-\Delta H_{products}+\Delta H_{reactants}$$

$$\Delta H_{products}=Cp_{Ti}(T_a-293K)+4(\Delta H_{fNaCl}+x\Delta H_{vNaCl}+(T_a-T_{mNaCl})Cp_{NaCll}+(T_{mNaCl}-293K)Cp_{NaCls})$$

$$\Delta H_{reactants}=\Delta H_{vTiCl4}+(T_{in}-293K)Cp_{TiCl41}+4(\Delta H_{fNa}+(T_{In}-T_{mNa})Cp_{Nal}+(T_{mNa}-293K)Cp_{Nas}$$

where $DH_{reaction}$=−841.5 kJ/mole heat of reaction $Cp_{Ti}$=28.0 J/moleK solid titanium heat capacity Ta=1738K adiabatic reaction temperature $\Delta H_{fNaCl}$=28.0 kJ/mole sodium chloride specific heat x=fraction of NaCl vaporized sodium chloride vapor fraction $\Delta H_{vNaCl}$=171.0 kJ/mole sodium chloride heat of vaporization $T_{mNaCl}$=1074K sodium chloride melting temperature $Cp_{Nacll}$=55.3 J/moleK liquid sodium chloride specific heat $Cp_{NaCls}$=58.2 J/moleK solid sodium chloride specific heat $\Delta H_{vTiCl}$=35.8 kJ/mole titanium tetrachloride heat of vaporization $T_{in}$=473K sodium inlet temperature $Cp_{TiCl41}$=145.2 J/moleK gaseous titanium tetrachloride specific heat $\Delta H_{fNa}$=2.6 kJ/mole sodium heat of fusion $T_{mNa}$=371K sodium melting temperature $Cp_{Nal}$=31.4 J/moleK liquid sodium specific heat $Cp_{Nas}$=28.2 J/moleK solid sodium specific heat Increasing the sodium flow rate to 6.3 kg/min at the same titanium tetrachloride rate will still give an adiabatic reaction temperature of 1465° C. but there will be about 0% sodium chloride vapor present in the reaction zone. Increasing the sodium flow rate above this level will cause a reduction in the adiabatic reaction temperature but at least to a flow of 7.6 kg/min, the reaction temperature will remain above the normal boiling temperature of sodium (883° C.) and all of the sodium will leave the reaction zone as vapor.

Accordingly, there has been disclosed an improved process for making and separating the products of the Armstrong process resulting from the exothermic reaction of a metal halide with a reducing metal. A wide variety of important metals and alloys can be made by the Armstrong process and separated according to this invention.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A method of producing an elemental material or an alloy thereof from a halide of the elemental material or halide mixtures comprising introducing the vapor halide of an elemental material or halide mixtures thereof into a liquid phase of a reducing metal of an alkali metal or alkaline earth metal or mixtures thereof present in excess of the amount needed to reduce the halide vapor to the elemental material or alloy resulting in an exothermic reaction between the vapor halide and the liquid reducing metal producing particulate elemental material or alloy thereof and the halide salt of the reducing metal and sufficient heat to vaporize substantially all the excess reducing metal, and separating the vapor of the reducing metal from the particulate elemental material or alloy thereof.

2. A method of producing Ti or a Ti alloy comprising introducing a Ti chloride vapor or a mixture of Ti chloride and other chloride vapors into a liquid continuum of a reducing metal of an alkali metal or alkaline earth metal or mixtures thereof initiating an exothermic reaction to form particulate Ti or Ti alloy and a chloride salt of the reducing metal, the reducing metal being present in excess of the stoichiometric amount required to react with the Ti chloride or mixture of Ti chloride and other chloride vapor, the exothermic reaction producing heat sufficient to vaporize substantially all the excess reducing metal, and separating the reducing metal vapor from the particulate Ti or Ti alloy and the chloride salt of the reducing metal.

3. A method of producing Ti or a Ti alloy, comprising producing Ti or Ti alloy particulates in an exothermic reaction by introducing Ti chloride vapor or a mixture of Ti chloride and other chloride vapor into a flowing stream of liquid reducing metal of an alkali metal or an alkali earth metal or mixtures thereof, the reducing metal being present in an amount in excess of the stoichiometric amount required to react all of the Ti chloride or mixtures of Ti chloride and other chloride vapor, the heat of reaction vaporizing the excess liquid reducing metal such that substantially no reducing metal is present as a liquid after the reaction, the Ti or Ti alloy particulates moving in a first direction through a vessel, establishing a flow of inert gas to contact the Ti or Ti alloy particulates to separate the substantially all the excess reducing metal vapor from the Ti or Ti alloy particulates, and removing the Ti or Ti alloy particulates from the vessel.

4. A method of producing Ti or a Ti alloy, comprising producing Ti or Ti alloy particulates from an exothermic reaction by introducing Ti chloride vapor or a mixture of Ti chloride and other chloride vapor into a flowing stream of liquid reducing metal of Na or Mg, the reducing metal being present in an amount in excess of the stoichiometric amount required to react all of the Ti chloride or mixtures of Ti chloride and other chloride vapor, the heat of reaction vaporizing substantially all the excess Na or Mg such that substantially no Na or Mg is present as a liquid after the reaction, the Ti or Ti alloy particulates moving downwardly through a vessel, establishing a flow of inert gas upwardly through the vessel for cooling the particulates and separating the excess Na or Mg vapor from the particulates, and removing the Ti or Ti alloy particulates from the vessel.

5. A method of producing Ti particles substantially free of Na, comprising introducing $TiCl_4$ vapor into a liquid continuum of Na to produce Ti particles and NaCl and heat in an exothermic reaction, the Na being present in an amount in the range of about 25% to 125% by weight in excess of the stoichiometric amount of Na needed to reduce all the $TiCl_4$ to Ti, the temperature of the reaction products of Ti and NaCl particles being maintained at less than about the boiling point of NaCl and greater than the boiling point of Na after the chemical reaction of $TiCl_4$ and Na such that substantially all excess Na is in the vapor phase, the Na vapor being separated from the reaction products of NaCl and Ti with a moving gas, and thereafter separating the Ti from the NaCl.

6. A method of producing an elemental material or an alloy thereof from a halide of the elemental material or halide mixtures comprising introducing the vapor halide of an elemental material or halide mixtures thereof into a liquid phase of a reducing metal of an alkali metal or alkaline earth metal or mixtures thereof present in excess of the amount needed to reduce the halide vapor to the elemental material or alloy resulting in an exothermic reaction producing particulate elemental material or alloy thereof and the halide salt of the alkali metal or alkaline earth metal or mixtures thereof, the temperature of the reaction products of the particulate elemental material or alloy thereof and the halide salt of the reducing metal being maintained at less than the boiling point of the halide salt of the reducing metal and greater than the boiling point of the reducing metal until substantially all excess reducing metal is vaporized, and separating the reducing metal vapor from the particulate elemental material or alloy thereof.

7. A method of producing an elemental material or an alloy thereof from a chloride of the elemental material or chloride mixtures comprising introducing the vapor chloride of an elemental material or chloride mixtures thereof into a flowing liquid phase of a reducing metal of sodium or magnesium, sodium if present in the liquid phase is in the range of from about 25% by weight to about 125% by weight in excess of the stoichiometric amount required for the reduction of the chloride vapor or magnesium if present in the liquid phase is in the range of from about 5% by weight to about 150% by weight in excess of the stoichiometric amount required for the reduction of the chloride vapor to the elemental material or alloy resulting in an exothermic reaction producing particulate elemental material or alloy thereof and sodium chloride or magnesium chloride and sufficient heat to vaporize substantially all the excess sodium or magnesium, and separating the sodium or magnesium vapor from the particulate elemental material or alloy thereof and sodium chloride or magnesium chloride with an inert sweep gas.

8. A method of producing an elemental material or an alloy thereof from a chloride of the elemental material or chloride mixtures comprising introducing the vapor chloride of an elemental material or chloride mixtures thereof into a flowing liquid phase of a reducing metal of sodium or magnesium, sodium if present in the liquid phase is not more than 85% by weight in excess of the stoichiometric amount required for the reduction of the chloride vapor or magnesium if present in the liquid phase is not more than about 75% by weight in excess of the stoichiometric amount required for the reduction of the chloride vapor to the elemental material or alloy resulting in an exothermic reaction producing particulate elemental material or alloy thereof and sodium chloride or magnesium chloride and sufficient heat to vaporize substantially all the excess sodium or magnesium, and separating the sodium or magnesium vapor from the particulate elemental material or alloy thereof and sodium chloride or magnesium chloride with an argon sweep gas.

9. A method of producing Ti or Zr or alloys thereof from a chloride of Ti or Zr or chloride mixtures comprising introducing the Ti or Zr vapor chloride or chloride mixtures thereof into a flowing liquid phase of a reducing metal of sodium or magnesium, sodium if present in the liquid phase is in the range of from about 25% by weight to about 125% by weight in excess of the stoichiometric amount required for the reduction of the chloride vapor or magnesium if present in the liquid phase is in the range of from about 5% by weight to about 150% by weight in excess of the stoichiometric amount required for the reduction of the chloride vapor to cause an exothermic reaction producing particulate Ti or Zr or alloys thereof and sodium chloride or magnesium chloride and sufficient heat to vaporize substantially all the excess sodium or magnesium while maintaining the temperature of the reaction products between the boiling point of the reducing metal and the boiling point of the salt produced, separating the sodium or magnesium vapor from the particulate Ti or Zr or alloys thereof and sodium chloride or magnesium chloride with an inert sweep gas of argon, and separating the particulate Ti or Zr or alloys thereof from the sodium chloride or magnesium chloride with water.

10. A method of producing an elemental material or an alloy thereof from a chloride of the elemental material or chloride mixtures comprising introducing the vapor chloride of an elemental material or chloride mixtures thereof into a flowing liquid phase of a reducing metal of sodium or magnesium, sodium if present in the liquid phase is in the range of from about 25% by weight to 125% by weight in excess of the stoichiometric amount required for the reduction of the chloride vapor or magnesium if present in the liquid phase is in the range of from about 5% by weight to 150% by weight in excess of the stoichiometric amount required for the reduction of the chloride vapor to the elemental material or alloy resulting in an exothermic reaction producing particulate elemental material or alloy thereof and sodium chloride or magnesium chloride and sufficient heat to vaporize substantially all the excess sodium or magnesium, and separating the sodium or magnesium vapor from the particulate elemental material or alloy thereof and sodium chloride or magnesium chloride with an inert sweep gas.

* * * * *